US007114917B2

(12) United States Patent
Legg

(10) Patent No.: US 7,114,917 B2
(45) Date of Patent: Oct. 3, 2006

(54) VANE ASSEMBLY FOR A GAS TURBINE ENGINE

(75) Inventor: David Thomas Legg, Bristol (GB)

(73) Assignee: Rolls-Royce plc, London (GB)

( * ) Notice: Subject to any disclaimer, the term of this patent is extended or adjusted under 35 U.S.C. 154(b) by 119 days.

(21) Appl. No.: 10/860,062

(22) Filed: Jun. 4, 2004

(65) Prior Publication Data

US 2004/0253096 A1 Dec. 16, 2004

(30) Foreign Application Priority Data

Jun. 10, 2003 (GB) ..... 0313393.1

(51) Int. Cl.
*F01D 9/04* (2006.01)
*F01D 25/24* (2006.01)

(52) U.S. Cl. ..... 415/137; 415/211.2

(58) Field of Classification Search ..... 415/211.2, 415/136, 137, 139

See application file for complete search history.

(56) References Cited

U.S. PATENT DOCUMENTS 2,807,433 A * 9/1957 Bernard et al. ..... 415/115
2,914,300 A * 11/1959 Douglas ..... 415/135
2,925,998 A * 2/1960 Hayes et al. ..... 415/137
2,928,648 A * 3/1960 Haines et al. ..... 415/138
2,930,579 A * 3/1960 Boyd et al. ..... 415/160
4,076,451 A * 2/1978 Jankot ..... 415/209.2
4,478,551 A * 10/1984 Honeycutt et al. ..... 415/142
4,563,128 A * 1/1986 Rossmann ..... 416/92
4,790,721 A * 12/1988 Morris et al. ..... 416/96 A
6,000,906 A * 12/1999 Draskovich ..... 415/209.4
6,547,518 B1 * 4/2003 Czachor et al. ..... 415/137
2002/0127097 A1 * 9/2002 Darolia et al. ..... 415/137

FOREIGN PATENT DOCUMENTS

GB 778855 7/1957
GB 2 174 458 A 11/1986
WO WO 82/01033 4/1982

* cited by examiner

*Primary Examiner*—Edward K. Look
*Assistant Examiner*—Nathan Wiehe
(74) *Attorney, Agent, or Firm*—Oliff & Berridge, PLC

(57) ABSTRACT

An exhaust diffuser unit for a gas turbine engine includes an outer ring, a diffuser cone and vanes, all made from a ceramic matrix composite material. Each vane has end components which have apertures through which a metallic support strut extends. The support strut is rigidly secured at its radially outer end to a diffuser casing, and is slidably but non-rotatably received at its radially inner end in an aperture in a boss provided on a drum. Structural loads between the casing and the drum are transferred through the strut independently of the vane. Gas loads on the vane are transferred to the strut by way of metallic end components.

20 Claims, 2 Drawing Sheets

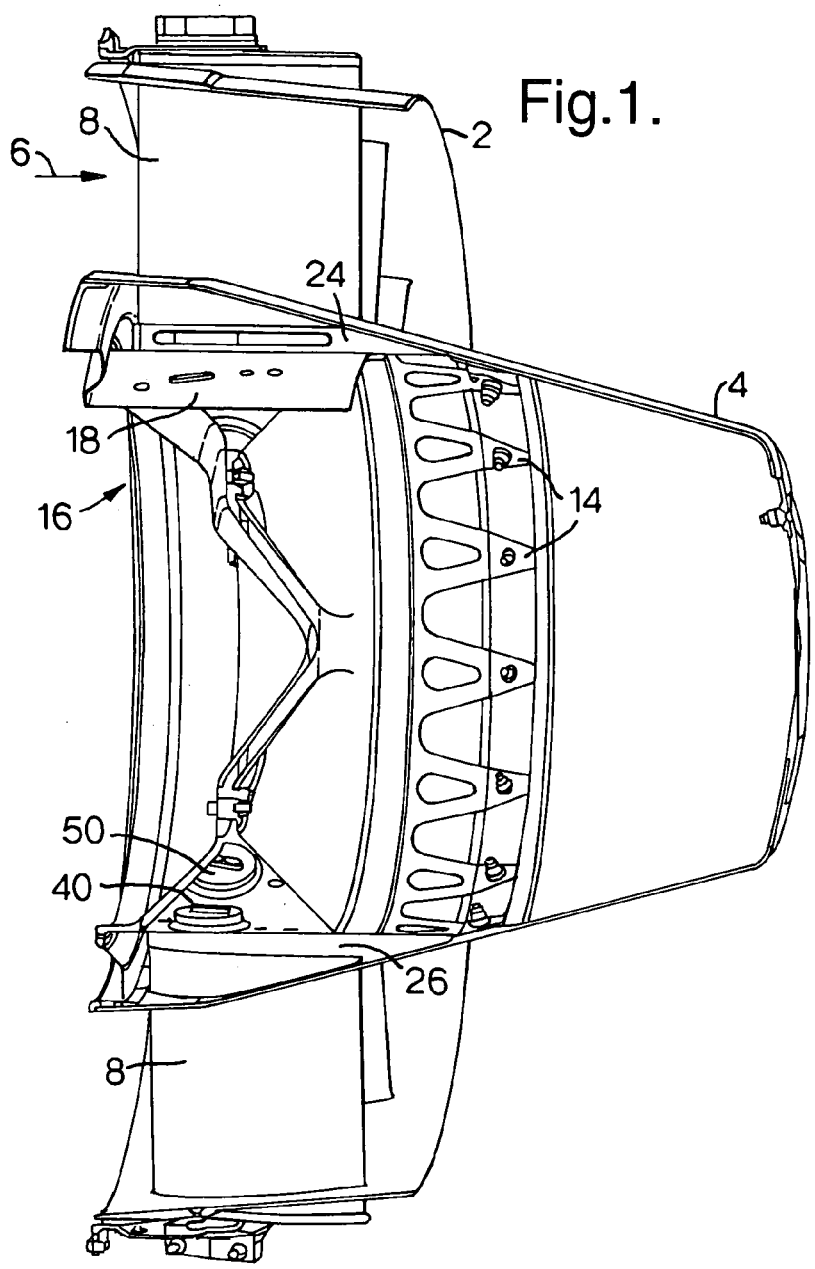
Fig.1.
Fig.3.
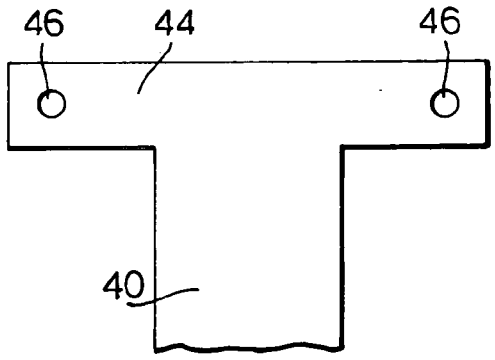

VANE ASSEMBLY FOR A GAS TURBINE ENGINE

This invention relates to a vane assembly for a gas turbine engine, and is particularly, although not exclusively, concerned with an outlet guide vane assembly incorporated in an exhaust diffuser unit.

Because the exhaust gases passing through the exhaust diffuser unit of a gas turbine engine are at very high temperatures, the components of the diffuser unit over which the exhaust gases will flow need to be made of specialised materials which can resist the temperatures to which they are subjected. Composite materials, and particularly ceramic matrix composite (CMC) materials, have been devised which can withstand these temperatures, but they lack strength by comparison with metallic materials. Their thermal expansion is lower than that of metallic materials and CMC components are difficult to manufacture, particularly if complex geometrical shapes are required. Consequently, special measures need to be taken if temperature-resistant CMC materials are to be used in gas turbine engines, and particularly in exhaust diffuser units.

Various measures have been proposed for mounting vanes made from ceramic materials in gas turbine engines so that they are protected from structural loads. For example, U.S. Pat. No. 3,843,279 discloses an arrangement in which nozzle guide vanes are mounted between inner and outer rings in a manner which enables them to pivot relatively to the rings so that bending forces are not applied to the vanes. U.S. Pat. No. 5,306,118 discloses a ceramic outlet guide vane extending between an exhaust nozzle and a diffuser cone. The vane is pivotably mounted at its radially outer end so that it may pivot, against spring loading, to accommodate axial displacement of the diffuser cone. However, the diffuser cone is supported by its engagement with the inner ends of the vanes, and consequently the loading applied by the diffuser cone is transferred to the casing of the engine through the vanes themselves.

According to the present invention there is provided a vane assembly for a gas turbine engine, the assembly comprising inner and outer support structures which respectively carry inner and outer rings defining an annular gas flow path between them, the assembly further comprising a plurality of hollow vanes which extend across the gas flow path and through respective openings in the inner and outer rings, a plurality of support struts extending between the support structures and through the vanes to locate the support structures relatively to each other, the vanes being provided with end components having apertures within which the support struts are slidably received to transfer loads imposed on the vanes to the support structures through the struts.

In an assembly in accordance with the present invention, structural loadings are transferred between the support structures by the support struts, and loads imposed on the vanes, for example loads imposed by the flow of exhaust gas over the vanes, are transferred to the support struts through the end components. Consequently, the vanes are not required to withstand structural loadings, and so can be made from relatively low-strength materials. Similar materials can be used for the inner and outer rings, since structural loads carried by the support struts are transferred directly to the inner and outer support structures without being applied to the inner and outer rings.

The vanes and/or one or both of the inner and outer rings may thus be made from a CMC material such as one comprising SiC fibres in an SiC matrix, which materials remain stable at temperatures in excess of 1600° C.

The struts and the apertures in the end components may have complementary shapes which are preferably non-circular so that the angular position of the vanes is maintained by the support struts. The shape of each aperture and the cross-sectional shape of each strut may be of elongate form, for example with oppositely disposed parallel sides. The struts may engage the apertures in sliding contact at the parallel sides, but with a clearance at the ends to accommodate movement, in the direction of the parallel sides, between the vanes and the struts.

The struts may be hollow, and may each have at least one internal partition to enhance rigidity.

The struts and/or the end components may, like the support structures of the assembly, be made from a metallic material such as a nickel-based superalloy, for example the material available under the designation C263. Alternatively, an intermetallic material such as gamma titanium aluminide may be used for the support struts and/or the end components and for other metallic components of the assembly.

At least one of the end components may comprise a peripheral band extending around the profile of the blade, and a central portion connected to the peripheral band and provided with the aperture. The end component is preferably bonded to the respective vane.

In a preferred embodiment, each support strut is rigidly secured to the respective support structure at one end of the strut. At the other end, the strut is mounted with respect to the support so as to be displaceable in its lengthwise direction relatively to the support structure, but rotationally fixed to the support structure.

For a better understanding of the present invention, and to show more clearly how it may be carried into effect, reference will now be made, by way of example, to the accompanying drawings, in which:

FIG. 1 shows an exhaust diffuser unit of a gas turbine engine;

FIG. 3 is a diagrammatic view of a component of the unit.

Figure 2:
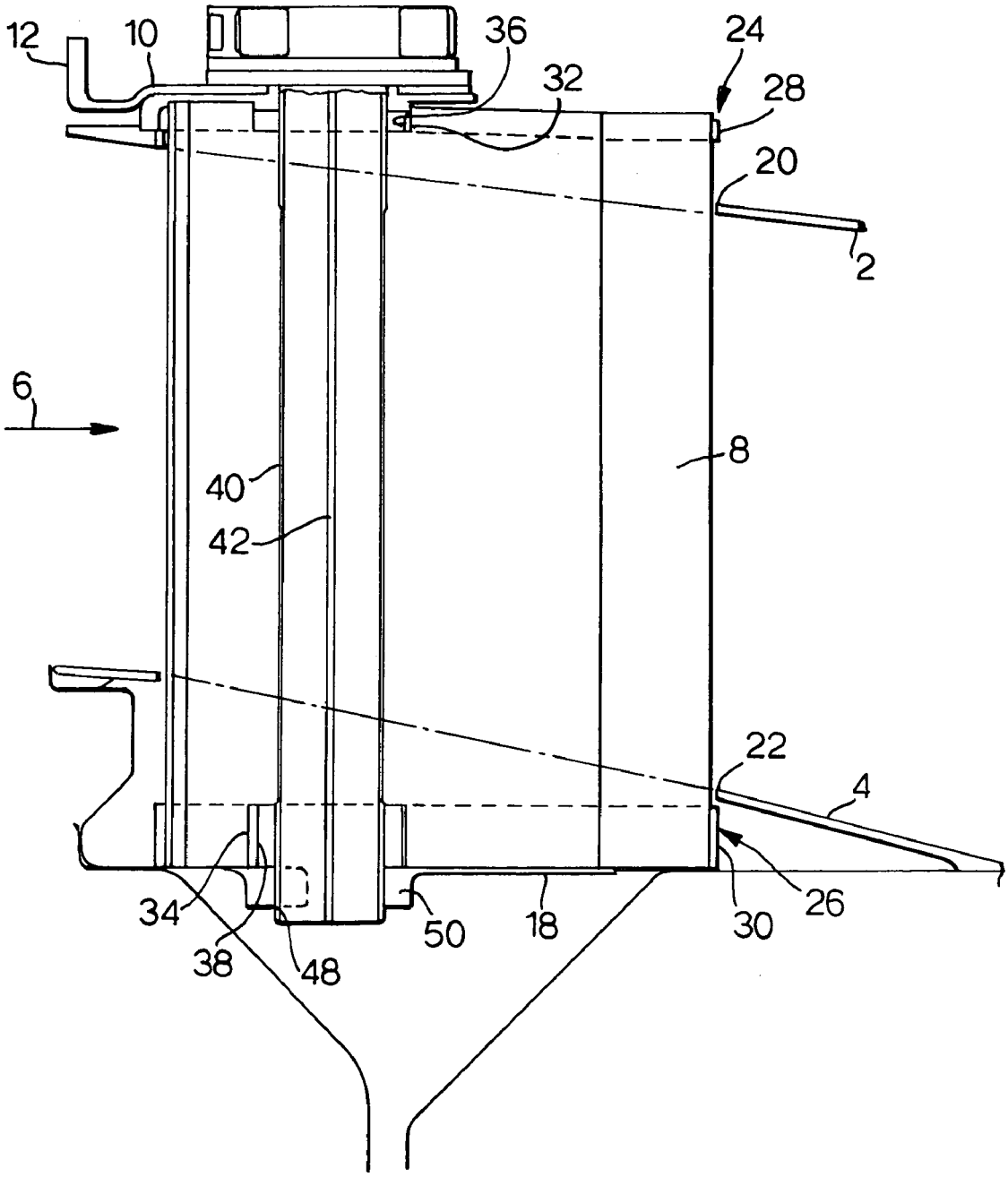
FIG. 2 is a sectional view through a vane of the unit of FIG. 1.

The exhaust diffuser unit shown in FIG. 1 comprises an outer ring 2 and a diffuser cone 4 which define between them a gas flow path 6. An array of outlet guide vanes 8 extends across the gas flow path 6 between the outer ring 2 and the cone 4.

The outer ring 2, the cone 4 and the vanes 8 are made from a CMC material.

The outer ring 2 is supported by a metallic diffuser casing 10 having a flange 12 by which the entire diffuser unit is attached to a low pressure turbine casing of a gas turbine engine. The diffuser casing 10 comprises an outer support structure of the unit.

The diffuser cone 4 is secured to fingers 14 of an inner support structure 16 which includes a cylindrical metallic drum 18.

It will be appreciated from FIG. 2 that each vane 8 projects through respective openings 20 and 22 in the outer ring 2 and the left-hand end of the diffuser cone 4 (as seen in FIG. 1) which can be regarded as an inner ring of the unit. The ends of the vanes 8 terminate close to the casing 10 and the drum 18. Each vane 8 is provided, at each end, with a respective metallic end component 24, 26. Each component 24, 26 comprises a peripheral band 28, 30 which extends around the vane 8 and is bonded to it. Each component 24, 26 also has a central portion 32, 34 which is connected to the respective band 28, 30 and is provided with a respective aperture 36, 38.

A respective metallic strut 40 extends through the hollow interior of each vane 8, and through the apertures 36, 38 in the end components 24, 26. The support strut 40 is hollow, and has a central partition 42. The strut has a generally flat configuration, having an elongate oval cross-section as can be seen in FIG. 1. This cross-section thus provides two oppositely disposed parallel sides which are closely engaged, as a sliding fit, between corresponding parallel sides of the apertures 36, 38, which can be regarded as being in the form of elongate slots. As shown in FIG. 2, a clearance may be provided at the ends of the apertures 36 to permit relative displacement between the vane 8 and the strut 40 in the lengthwise direction of the slot-like apertures 36, 38.

At their radially outer ends (ie the upper end of the strut shown in FIG. 2), the struts 40 are secured to bosses (not shown in detail) welded to the casing 10. For this purpose, as shown in FIG. 3, each strut 40 has a transverse flange 44 provided with holes 46 for receiving securing bolts. Each strut 40 is thus secured rigidly to the casing 10.

At its radially inner end, the strut 40 is a close sliding fit in an aperture 48 in a load-spreading boss 50 formed on the internal surface of the drum 18. As at the radially outer end, the strut 40 passes through the central region 34 of the end component 26 with a similar clearance at the ends of the slot-like aperture 38.

In this specification, the expression "metallic" embraces not only true metal, alloys and superalloys, but also intermetallic materials. The metallic components of the assembly, and particularly the strut 40 and the end components 24, 26, may be made from a suitable aerospace alloy, such as a nickel-based superalloy. For example, the material may be a Nimonic alloy available under the designation C263. Alternatively, these components may be made from an intermetallic titanium based aluminide, for example gamma titanium aluminide. The preferred materials for these components exhibit high strength, low density and good resistance to high temperatures.

In operation, none of the CMC components, namely the outer ring 2, the diffuser cone 4 and the vanes 8, is subjected to structural loadings. The outer ring 2 and the diffuser cone 4 are supported, independently of each other, on the inner and outer support structures including respectively the casing 10 and the drum 18. The vanes 8 can move in their lengthwise directions by sliding along the strut 40, being limited in this movement only by contact with the casing 10 or the drum 18. The clearances at the ends of the slot-like apertures 36, 38 permit chordwise displacement of the vanes 8, this movement being limited either by contact with the edges of the openings 20, 22 or, if desired, by appropriate control of the clearances at the slot-like apertures 36, 38. With this construction, therefore, the vanes 8 are isolated from loadings between the inner and outer support structures 10 and 16 generated, for example, by differential expansion between the components of the unit.

Gas loading on the vanes 8, which tends to rotate the vanes about an axis extending generally radially of the unit, are resisted by engagement between the strut 40 and the parallel sides of the apertures 36, 38. These gas loadings are transferred from the vane 8 to the strut 40 through the end components 24, 26 and thence to the inner and outer support structures 10, 16 by the rigid mounting of the strut 40 at its radially outer end and the cooperation between the lower end of the strut 40 and the correspondingly shaped aperture 48.

The hollow struts 40 serve as passages for cooling air from a source outside the casing of the engine to which the diffuser casing 10 is attached at the flange 12. The cooling air travels radially inwardly through the struts 40 to a metal manifold situated within the diffuser cone 4.

It will be appreciated that, although the present invention has been described with reference to outlet guide vanes in an exhaust diffuser unit, a similar mounting structure may be used for guide vanes in other parts of a gas turbine engine.

The invention claimed is:

1. A vane assembly for a gas turbine engine, the assembly comprising inner and outer support structures which respectively carry inner and outer rings defining an annular gas flow path between them, the assembly further comprising a plurality of hollow vanes which extend across the gas flow path and through respective openings in the inner and outer rings, a plurality of support struts extending between the support structures and through the vanes to locate the support structures relatively to each other, the vanes being provided with end components having apertures within which the support struts are slidably received to transfer loads imposed on the vanes to the support structures through the struts.

2. A vane assembly as claimed in claim 1, in which the struts and the apertures in the end components have cooperating non-circular shapes which prevent relative rotation between the struts and the end components.

3. A vane assembly as claimed in claim 2, in which the cross-sectional shape of the struts and the shapes of the apertures have an elongate form oriented generally in the chordwise direction of the respective vanes.

4. A vane assembly as claimed in claim 2, in which the apertures in the end components have oppositely disposed parallel sides in sliding engagement with opposite sides of the respective struts.

5. A vane assembly as claimed in claim 1, in which the struts are hollow.

6. A vane assembly as claimed in claim 5, in which the interior of each strut is partitioned.

7. A vane assembly as claimed in claim 1, in which the material of the end components and the struts is metallic.

8. A vane assembly as claimed in claim 7, in which the metallic material is a nickel-based superalloy.

9. A vane assembly as claimed in claim 7, in which the material of the end components and the struts are is an intermetallic material.

10. A vane assembly as claimed in claim 9, in which the material is gamma titanium aluminide.

11. A vane assembly as claimed in claim 1, in which the end component at least one end of each vane comprises a peripheral band extending around the exterior of the vane, and a central portion connected to the peripheral band and provided with the respective aperture.

12. A vane assembly as claimed in claim 11, in which the peripheral band is bonded to the respective vane.

13. A vane assembly as claimed in claim 1, in which each strut is rigidly secured at one end to the respective inner or outer support structure.

14. A vane assembly as claimed in claim 13, in which each strut is mounted at its other end to the respective outer or inner support structure so as to be axially displaceable relative to the respective structure.

15. A vane assembly as claimed in claim 14, in which each strut is rotationally fixed to the respective structure at its other end.

16. A vane assembly as claimed in claim 1, in which the inner and outer rings and the vanes are made from a fibre reinforced composite material.

17. A vane assembly as claimed in claim 16, in which the material is a ceramic matrix composite material.

18. A vane assembly as claimed in claim 16, in which the material comprises SiC fibres in an SiC matrix.

19. A vane assembly as claimed in claim 1, which comprises an exhaust diffuser unit.

20. A gas turbine engine including a vane assembly in accordance with claim 1.

* * * * *